US009576459B2

(12) United States Patent
Park

(10) Patent No.: US 9,576,459 B2
(45) Date of Patent: Feb. 21, 2017

(54) EVACUATION GUIDANCE NOTIFICATION DEVICE AND SYSTEM

(71) Applicant: Im Su Park, Busan (KR)

(72) Inventor: Im Su Park, Busan (KR)

( * ) Notice: Subject to any disclaimer, the term of this patent is extended or adjusted under 35 U.S.C. 154(b) by 0 days.

(21) Appl. No.: 14/904,510

(22) PCT Filed: Jul. 15, 2014

(86) PCT No.: PCT/KR2014/006304

§ 371 (c)(1),
(2) Date: Jan. 12, 2016

(87) PCT Pub. No.: WO2015/008990

PCT Pub. Date: Jan. 22, 2015

(65) Prior Publication Data

US 2016/0140823 A1 May 19, 2016

(30) Foreign Application Priority Data

Jul. 15, 2013 (KR) ..... 10-2013-0082644

(51) Int. Cl.
*G08B 17/10* (2006.01)
*G08B 7/06* (2006.01)
*G08B 17/113* (2006.01)

(52) U.S. Cl.
CPC ..... *G08B 17/10* (2013.01); *G08B 7/066* (2013.01); *G08B 17/113* (2013.01)

(58) Field of Classification Search
CPC ..... G08B 17/10; G08B 17/113; G08B 7/066; G08B 21/18; G08B 29/02; G08B 7/064; G08B 7/062; G08B 5/36; G08B 7/06; G08B 5/38; G08B 27/001; H04B 1/401; G08F 11/324; G08F 11/325; G09F 13/005; G09F 2013/222; G09F 19/22; G02B 6/00
(Continued)

(56) References Cited

U.S. PATENT DOCUMENTS 4,385,586 A * 5/1983 Schriever ..... A62B 3/00 116/205
5,612,665 A * 3/1997 Gerhardsen ..... E04F 11/18 116/205
(Continued)

FOREIGN PATENT DOCUMENTS

JP 2015-162148 A 9/2015
KR 10-2002-0038983 A 5/2002
(Continued)

*Primary Examiner* — Anh V La
(74) *Attorney, Agent, or Firm* — Rabin & Berdo, P.C.

(57) ABSTRACT

The present invention relates to an evacuation guidance notification system that can detect a fire, can provide notification, can provide guidance on an evacuation route, and can re-ensure a field of vision. The evacuation guidance notification system includes an evacuation guidance notification device installed on a banister post at an edge of a staircase, and the evacuation guidance notification device includes a device housing including a display window, a speaker, a beam output unit, an LED unit, a sensor unit, a control unit, a power unit, a communication unit, and an evacuation direction guidance unit. Furthermore, the device housing constituting part of the evacuation guidance notification device may further include a communication unit configured to communicate with the outside and a control room composed of a computer for controlling the evacuation guidance notification device, and the control room may remotely control the evacuation guidance notification device via the communication unit.

4 Claims, 10 Drawing Sheets

(58) Field of Classification Search
USPC ..... 340/331, 332, 326, 628, 577, 584,340/286.01, 286.05, 540, 815.4, 815.45, 691.1,340/691.4; 40/544; 362/259, 237, 236, 244, 362/146; 116/205, 202
See application file for complete search history.

(56) References Cited

U.S. PATENT DOCUMENTS

| | | | | |
|---|---|---|---|---|
| 7,800,511 | B1 * | 9/2010 | Hutchison | G08B 7/066 340/3.1 |
| 2005/0146442 | A1 * | 7/2005 | Chen | F21V 33/006 340/815.45 |
| 2009/0066522 | A1 * | 3/2009 | Lee | G08B 7/066 340/577 |

FOREIGN PATENT DOCUMENTS

| | | | |
|---|---|---|---|
| KR | 10-2009-0054360 | A | 5/2009 |
| KR | 10-2011-0059161 | A | 6/2011 |
| KR | 10-2012-0103529 | A | 9/2012 |

* cited by examiner

EVACUATION GUIDANCE NOTIFICATION DEVICE AND SYSTEM

TECHNICAL FIELD

The present invention relates to an evacuation guidance notification system including an evacuation guidance notification device that provides guidance on evacuation in case of fire, and more particularly to an evacuation guidance notification system that, when a sensor formed in an evacuation guidance notification device detects a fire, outputs information about an outbreak of fire via a speaker formed in the evacuation guidance notification device in the form of voice, thereby providing notification of the outbreak of fire.

The present invention relates to an evacuation guidance notification system in which an LED formed in an evacuation guidance notification device and configured to emit light emits lights of different colors in case of fire, and thus guidance on a safe evacuation route is provided via the LED.

The present invention relates to an evacuation guidance notification system in which a beam output unit formed in an evacuation guidance notification device installed on a banister post of a staircase radiates a beam in a direction to a step of the staircase in case of fire, thereby ensuring a safe evacuation route and the fields of vision of evacuees.

BACKGROUND ART

Today buildings are used for various purposes, such as an office purpose, a residence purpose, and the like. As the functionality of society becomes complicated and diversified, the sizes of buildings are increasing, and more people are spending time inside the buildings.

Meanwhile, when an emergency situation occurs in such a building, massive damage may be caused. In this case, loss of lives that cannot be recovered unlike recoverable damage of property may occur.

In order to reduce damage of property and loss of lives, it is important to extinguish a fire in its early stage.

For this purpose, apparatuses that, when an emergency situation, particularly and chiefly a fire in a building, occurs, detect the situation and automatically issue an alarm sound, thereby providing notification of an outbreak of fire, have been developed and used in most buildings.

However, conventional fire alarm apparatuses are used as a means for providing notification of a fire, and are not provided with a means for aiding in escape or evacuation.

Accordingly, people who do not know the structure of a building may be subjected to an accident while wandering around the building in confusion. Even people who know the structure of the building may be subjected to an accident among people who evacuate at the same time along an evacuation route during evacuation.

That is, most loss of lives attributable to outbreaks of fire occur due to choking incidents while wandering around a building or incidents caused by getting hit by people during evacuation.

Accordingly, apparatuses for providing guidance on an evacuation route when an emergency situation occurs have been developed. In connection with this, the present applicant filed Korean Patent Application No. 10-2012-0085515 entitled "Fire Image and Voice Detection Apparatus" on Aug. 6, 2012, and received a patent for the technology.

This technology is directed to a fire image and voice detection device which is installed on the ceiling of a building, which transmits an image signal when a fire breaks out, thereby enabling the outbreak of fire to be recognized over a remote distance, which stores the image, thereby enabling the cause of the outbreak of fire to be easily identified, and which emits LED light aiding in ensuring a field of vision in a smoky environment, thereby providing guidance on an evacuation route.

However, the area in which many accidents may occur in case of emergency, such as a fire or the like, is a staircase in a building. Secondary accidents (for example, falling on the staircase, rolling on the staircase, and injury caused by getting hit during evacuation) attributable to an emergency situation may occur due to tripping on the staircase.

Furthermore, relaying on the light of the LED and using a staircase through which a plurality of persons evacuate at the same time in a situation in which it is difficult to ensure a field of vision due to smoke or the like in an emergency situation have practical difficulty preventing secondary accidents attributable to an outbreak of fire.

Meanwhile, technology for providing guidance on evacuation in order to enable safe evacuation along a staircase, i.e., a principal evacuation route, in case of fire, has been developed. In connection with this, Korean Patent Application Publication No. 10-2002-0038983 discloses a non-slip device for a staircase. This will be described via the attached FIG. 1.

FIG. 1 is a view schematically showing the configuration of the conventional non-slip device for a staircase.

As to the above-described technology, the above-described technology is directed to a non-slip device for a staircase, which enables an ordinary person to easily identify the location at which a staircase is installed in a dark place, such as the basement of a building, even in an emergency situation, such as a power failure or a fire. The above-described technology is directed to a non-slip device for a staircase, which is installed on a staircase of a building, a lamp is included such that the location of the staircase can be easily identified in an emergency situation, such as a power failure or a fire, and light is emitted using constant power in the building in normal times and is emitted using a battery in case of power failure or fire, thereby enabling people to evacuate rapidly.

Furthermore, FIG. 1 of the attached drawings shows a non-slip body 10 that is fastened and coupled to a staircase.

The non-slip body 10 includes a fastening wall 11 formed perpendicular to a staircase, and a surface wall 12 formed to be spaced apart from the fastening wall 11.

That is, lamps 20 are inserted into a space that extends between the fastening wall 11 and the surface wall 12.

In this case, an edge of the surface wall 12 of the non-slip body 10 is configured to be inclined so that a transparent window 30 can be inserted thereinto. The light of the lamps 20 is emitted to the outside via the transparent window 30.

However, the above-described technology has problems in that the inconvenience of installing the non-slip device on each staircase occurs and accordingly installation costs and manpower increase.

Furthermore, in light of the fact that the above-described technology functions to provide notification of the location of a staircase and guidance on an evacuation route in case of emergency, a field of vision needs to be ensured by emitted light when it is difficult to ensure the field of vision due to a state of darkness attributable to a power failure or smoke in an emergency situation. However, when guidance is provided to an evacuee by passing the light of the lamps via the configuration shown in FIG. 1 of the attached drawings, there is a risk in which a secondary accident attributable to an emergency situation may be caused by the tripping of the evacuee or the like.

Therefore, there is a demand for the development of a system for providing guidance on evacuation, which can provide guidance on an accurate evacuation route via an apparatus, which can prevent secondary accidents by accurately indicating a staircase, and which is applicable regardless of the type or material of widely commercialized staircase.

DISCLOSURE

Technical Problem

Accordingly, the present invention is intended to meet the above-described demand, and an object of the present invention is to provide an evacuation guidance notification system in which an evacuation guidance notification device configured to provide guidance on evacuation in case of fire is included and a sensor configured to detect a fire using heat, smoke and gas is formed in the evacuation guidance notification device, thereby outputting a voice providing notification of an outbreak of fire via a speaker formed in the evacuation guidance notification device when a fire is detected.

Another object of the present invention is to provide an evacuation guidance notification system in which an LED formed in an evacuation guidance notification device and configured to emit light emits lights of different colors in case of fire, and thus guidance on a safe evacuation route is provided via the LED.

A further object of the present invention is to provide an evacuation guidance notification system in which a beam output unit formed in an evacuation guidance notification device installed on a banister post of a staircase radiates a beam in a direction to a step of the staircase in case of fire, thereby ensuring a safe evacuation route and the fields of vision of evacuees.

Still another object of the present invention is to provide an evacuation guidance notification system in which a communication unit capable of communicating with the outside is further included in an evacuation guidance notification device and thus the evacuation guidance notification device can be remotely controlled.

Technical Solution

In order to accomplish the above objects, the present invention provides an evacuation guidance notification device formed in a ring shape having an opening so that it is fitted and installed on a banister post of a staircase, wherein the evacuation guidance notification device includes a device housing including a display window, a speaker, a beam output unit, an LED unit, a sensor unit, a control unit, a power unit, a communication unit, and an evacuation direction guidance unit, the sensor unit detects a fire by sensing heat, smoke or gas generated by the fire, and outputs a signal, the LED unit emits LED light in normal times, and emits LED light of another color based on the signal of the sensor unit when a fire breaks out, the beam output unit emits a beam in a direction to a step of the staircase in normal times, and emits LED light of another color based on the signal of the sensor unit when a fire breaks out, and the evacuation direction guidance unit guides an evacuee through an evacuation direction along the staircase in case of fire.

Furthermore, in the present invention, the device housing constituting part of the evacuation guidance notification device may further include a communication unit configured to communicate with the outside and a control room composed of a computer for controlling the evacuation guidance notification device, and the control room may remotely control the evacuation guidance notification device via the communication unit.

Advantageous Effects

The present invention has the effect of enabling evacuees to safely evacuate because the evacuation guidance notification devices are installed on banister posts of staircases, because the fields of vision of evacuees can be ensured via the LED units formed in the evacuation guidance notification devices even when the fields of vision are obstructed by smoke and the like in case of fire, and because an evacuation route can be ensured and guidance can be provided via the beam output units.

Accordingly, secondary accidents (tripping, getting hit by another evacuee during evacuation, confusion attributable to ignorance about the structure of a building, and the like) that may occur during evacuation can be prevented.

The present invention has the effect of enabling people to become aware of an outbreak of fire because light emitted by the LED formed in the evacuation guidance notification device is configured to be emitted in another color in case of fire, and also has the effect of guiding an evacuee through rapid evacuation in case of fire because a voice providing notification of an outbreak of fire is output via the speaker.

The present invention has the effect of guiding an evacuee through accurate and rapid evacuation because the evacuation guidance notification device according to the present invention is installed on one side of a staircase and radiates a beam onto a step of the staircase, thereby providing accurate notification of the boundary of the step of the staircase.

The present invention has an effect in which control is performed such that notification of an outbreak of fire can be provided throughout an entire building even when a fire breaks out in part of the building and thus guidance on an evacuation route can be provided because the communication units capable of communicating with the outside can be provided in the evacuation guidance notification devices, and thus remote control can be performed.

MODE FOR INVENTION

Figure 1:
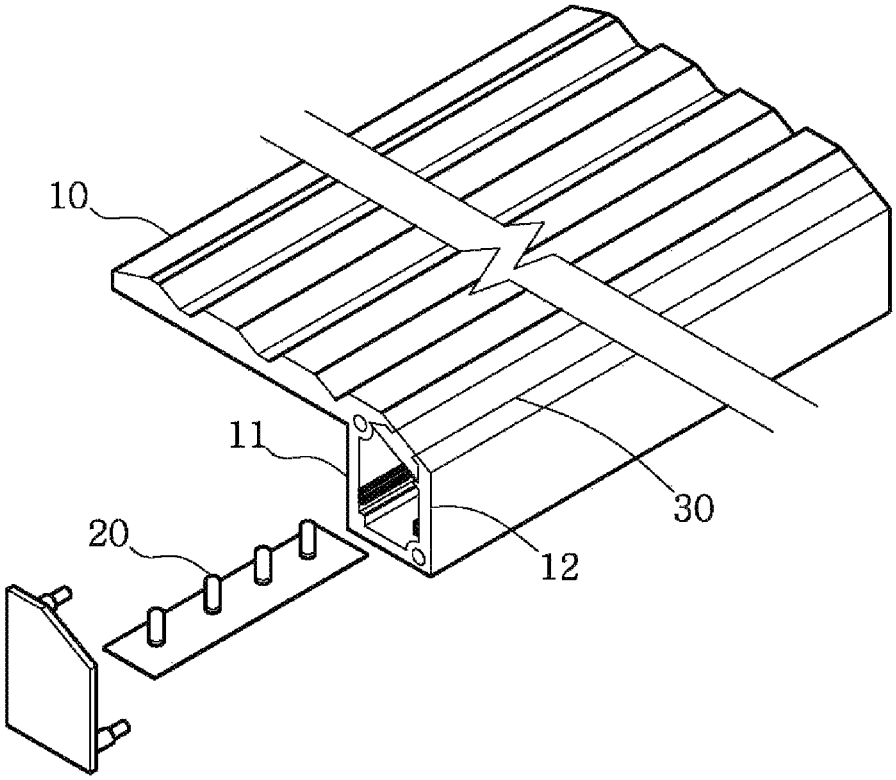
FIG. 1 is a view schematically showing the configuration of a conventional non-slip device for a staircase.

The terms and words used in the present specification and the claims should not be limitedly interpreted as having common and dictionary meanings, but should be interpreted as having meanings and concepts conforming to the technical spirit of the present invention based on the principle that an inventor can appropriately define the concepts of terms and words in order to describe his or her invention in the best way.

Accordingly, since the embodiments described in the present specification and the configurations shown in the drawings are merely the most preferred embodiments of the present invention and do not represent all the technical spirit of the present invention, it should be appreciated that there may be various equivalents and modifications that may replace the configurations at the time at which the present application is filed.

Prior to giving the following description with reference to the diagrams, it is noted that in order to reveal the gist of the present invention, unnecessary items, i.e., well-known configurations that may be apparently added by those having common knowledge, are neither illustrated nor described in greater detail.

In other words, in the present specification, components for achieving the objects of the present invention (for example, an evacuation guidance notification device, and a control room) may be chiefly described. Accordingly, it is emphasized that the present invention is not limited to the configurations.

Prior to the following description, the present invention is referred to as an evacuation guidance notification device and an evacuation guidance notification system because the present invention is intended to achieve the objects of guiding and notifying an evacuee through and of an evacuation direction.

The present invention relates to an evacuation guidance notification system configured to include an evacuation guidance notification device that provides evacuation guidance in case of fire.

However, according to another condition, the evacuation guidance notification system including an evacuation guidance notification device according to the present invention may be used in the case of an outbreak of another emergency situation in addition to the case of an outbreak of a fire, and may be used for the purpose of performing identification at night. It is sufficient if the object of guiding an evacuee through safe evacuation is achieved.

Furthermore, the evacuation guidance notification system includes at least one evacuation guidance notification device 100 and a control room 200. This evacuation guidance notification system will be described via the attached drawings.

Figure 2:
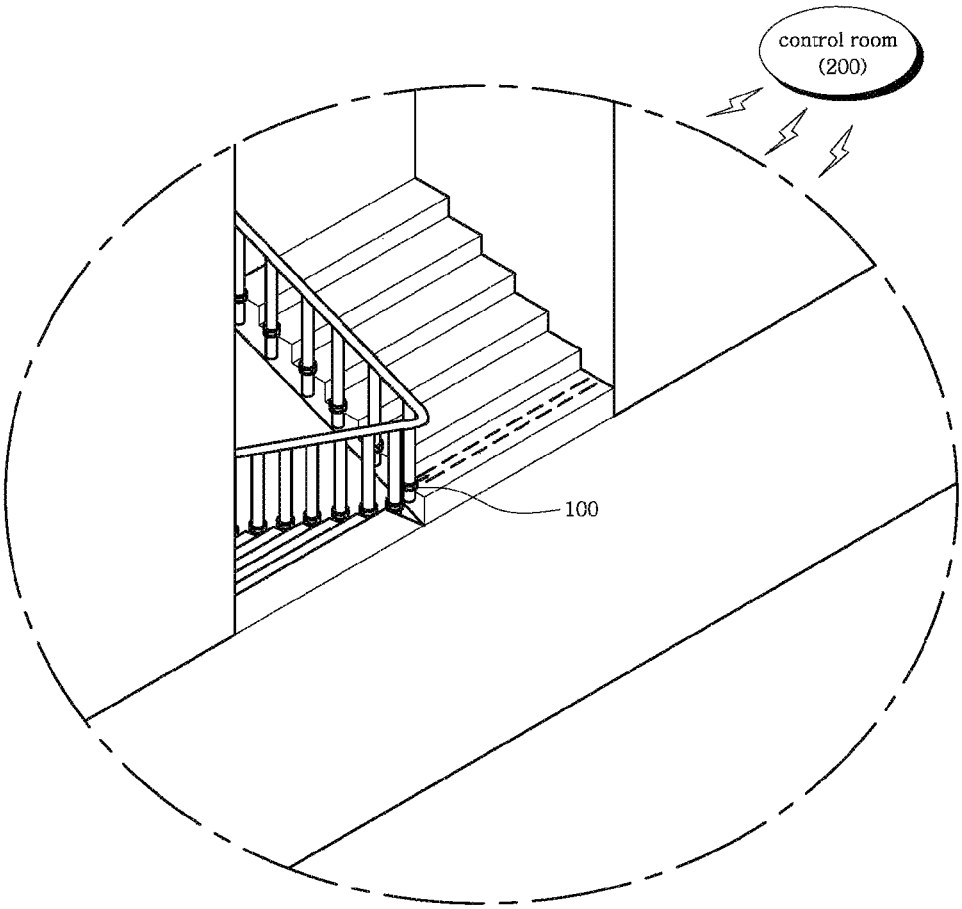
FIG. 2 is a view schematically showing the configuration of an evacuation guidance notification system according to the present invention.

FIG. 2 is a view schematically showing the configuration of an evacuation guidance notification system according to the present invention. The evacuation guidance notification system includes an evacuation guidance notification device 100.

The evacuation guidance notification device 100 may be formed on one side of each staircase.

More preferably, the evacuation guidance notification device 100 is formed on a banister post installed upwardly perpendicular to a support surface at an edge of the staircase in order to fasten a handrail formed on one side of the staircase.

In this case, the banister post is a structure that stands upright at an edge of a step of a staircase at a predetermined height, and refers to a structure that is formed on a staircase for the purpose of protecting people from a falling accident or providing an aesthetic appearance.

Figure 3A:
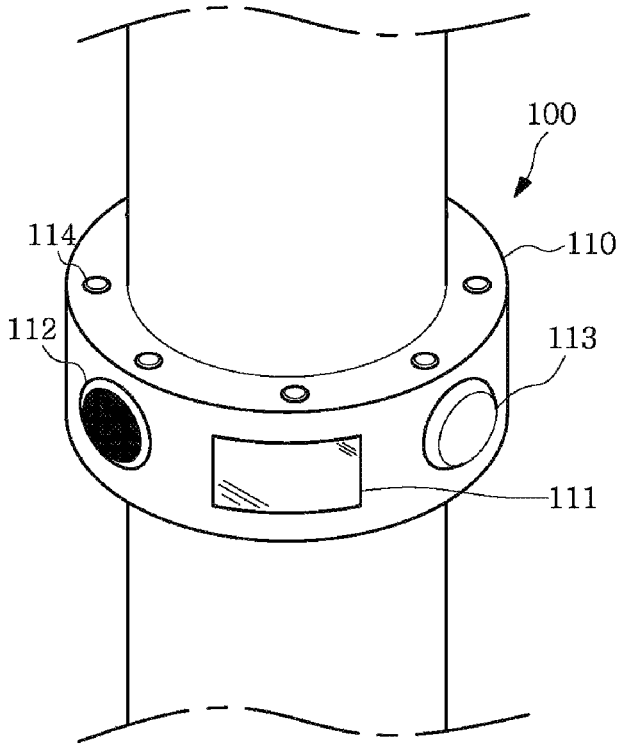
FIG. 3*a* is a view schematically showing the configuration of an evacuation guidance notification device in an evacuation guidance notification system according to the present invention.
Figure 3B:
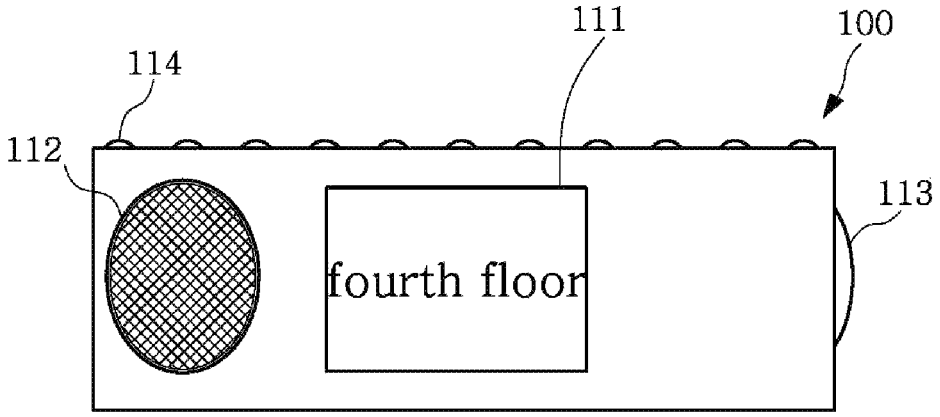
FIG. 3*b* is a view schematically showing the frontal configuration of an evacuation guidance notification device in an evacuation guidance notification system according to the present invention.

The structure of the evacuation guidance notification device 100 is described via FIGS. 3*a* and 3*b* of the attached drawings, as follows:

FIG. 3*a* is a view schematically showing the configuration of an evacuation guidance notification device in an evacuation guidance notification system according to the present invention, and FIG. 3*b* is a view schematically showing the frontal configuration of an evacuation guidance notification device in an evacuation guidance notification system according to the present invention.

Figure 3C:
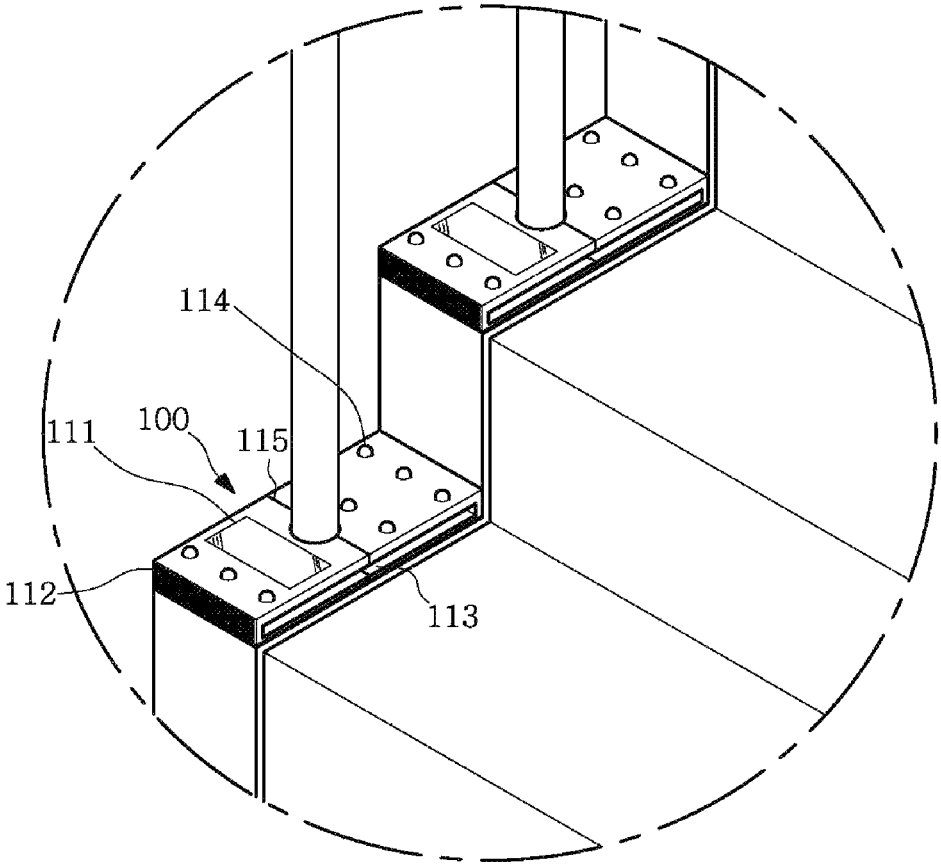
FIG. 3*c* is a view schematically showing another shape of an evacuation guidance notification device in an evacuation guidance notification system according to the present invention.

Furthermore, FIG. 3*c* is a view schematically showing another shape of an evacuation guidance notification device in an evacuation guidance notification system according to the present invention.

Prior to the following detailed description, it is noted that the evacuation guidance notification system according to the present invention is not limited to the configurations shown in the attached drawings, but may be formed in various shapes compatible with the shapes of conventional staircases formed in various shapes while including functional components described in the present specification.

For example, the conventional staircase shown in FIG. 3*c* of the attached drawings has a shape generally and chiefly adopted and used in many buildings, and the shape of the evacuation guidance notification device 100 according to the present invention may be formed to be compatible with the staircase based on the shape of the staircase.

As shown in FIGS. 3*a* and 3*b* of the attached drawings, the evacuation guidance notification device 100 includes a device housing 110 including a display window 111, a speaker 112, a beam output unit 113, and an LED unit 114.

The display window 111 displays information about a floor on which the evacuation guidance notification device 100 is installed.

Accordingly, an evacuee who is confused in case of fire may be notified of information about a floor on which the evacuee stays.

The speaker 112 outputs a voice providing notification of an outbreak of fire.

In this case, the voice includes not only the announcement of an outbreak of fire but also an alarm sound indicative of an outbreak of fire. In this case, the announcement of an outbreak of fire or the alarm sound indicative of an outbreak of fire may be set by the manipulation of an operator who operates the evacuation guidance notification system according to the present invention in various manners.

The beam output unit 113 is formed in a direction to a step of a staircase in the evacuation guidance notification device 100 formed on one side of a staircase.

This is intended to output a beam onto the step of the staircase, and is preferably composed of an LED beam.

In other words, the beam output unit 113 provides a predetermined indication to the step of the staircase by means of an LED beam (see the dotted line of the attached FIG. 2).

According to another condition, the beam radiated onto the step of the staircase may be configured to be radiated onto the step of the staircase in normal times and to be changed into a beam of another color in case of fire.

For example, a green beam is radiated in normal times, and a red beam is radiated in case of fire.

In this case, the color of the beam radiated by the beam output unit 113 may vary depending on the manipulation of an operator.

The LED unit 114 emits light via an LED, and emits light of another color in case of fire.

For example, the LED unit 114 emits green LED light in normal times, and emits red LED light in case of fire. The color of the light emitted by the LED unit 114 may vary depending on the manipulation of an operator.

In other words, in connection with the configuration in which the beam output unit 113 emits LED light and the configuration in which the LED unit 114 radiates a beam, which are formed in the evacuation guidance notification device 100 of the evacuation guidance notification system according to the present invention, it will be apparent that the LED unit and the beam output unit may be configured to include various colors, and thus may be configured to select either a normal color or a color in case of fire in various manners according to the manipulation or selection of an operator.

Accordingly, the light of the LED enables a user to recognize an outbreak of fire and evacuate, to be guided through an evacuation route, and to ensure a field of vision that is obstructed by smoke and the like in case of fire, thereby providing guidance on safe evacuation.

This evacuation guidance notification device 100 includes the device housing 110 including the above-described functions. The device housing 110 is divided into a first housing 110*a* and a second housing 110*b*, which is described via the attached FIG. 4.

Figure 4:
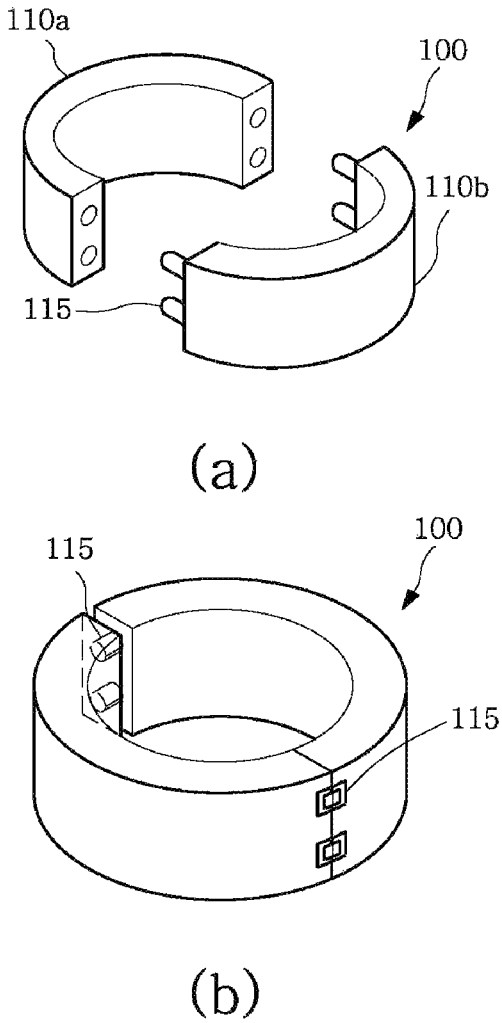
FIG. 4 shows the coupling configuration of an evacuation guidance notification device in an evacuation guidance notification system according to the present invention.

FIG. 4 is a view showing the coupling configuration of the evacuation guidance notification device in the evacuation guidance notification system according to the present invention. FIG. 4 of the attached drawings shows a configuration in which the first housing 110*a* and the second housing 110*b* are completely divided and separated from each other (FIG. 4(*a*)) and a configuration in which the first sides of the first housing 110*a* and the second housing 110*b* include a configuration connecting the first housing 110*a* and the second housing 110*b*, such as hinges or the like, and connectors are formed only on the second sides thereof (FIG. 4(*b*)).

As shown in FIG. 4 of the attached drawings, the device housing 110 is divided into the first housing 110*a* and the second housing 110*b*. The reason for this is to install the evacuation guidance notification device 100 on a banister post of a conventional staircase.

That is, since the top of the banister post of the conventional staircase is usually blocked by a handrail, the housing 110 is divided into the first housing 110*a* and the second housing 110*b* in order to install the evacuation guidance notification device 100 on the banister post of the staircase.

Accordingly, since, depending on the condition under which the evacuation guidance notification device 100 according to the present invention is installed, the evacuation guidance notification device 100 may be installed through fitting when the evacuation guidance notification device 100 may be installed by fitting the evacuation guidance notification device 100 around a banister post of a staircase or when a staircase is newly constructed, the housing 110 of the evacuation guidance notification device 100 may not be divided into the first housing 110*a* and the second housing 110*b*.

In this case, the evacuation guidance notification device 100 of the evacuation guidance notification system according to the present invention is provided with connector portions 115 configured to connect the first housing 110*a* and the second housing 110*b*, thereby electrically connecting them.

In other words, the display window 111, the speaker 112, the beam output unit 113, the LED unit 114, a sensor unit 116, a control unit 117, a power unit 118 and a communication unit 119 are accommodated in the device housing 110, and are freely separated and formed in the first housing 110*a* or the second housing 110*b* as required. It is sufficient if the above components are configured to be electrically connected and signals of the respective components (see reference symbols 111 to 119) can operate in cooperation with each other.

Furthermore, in connection with the connector portions 115, as described above, the first housing 110*a* and the second housing 110*b* may be completely separated and connected by the connector portions 115, as shown in FIG. 4(*a*) of the attached drawings, and a coupling means, such as hinges, may be provided to the first sides of the first housing 110*a* and the second housing 110*b* and the second sides are coupled with the connector portions 115, as shown in FIG. 4(*b*). In this case, it is sufficient if the above-described cooperative operation of signals is achieved.

The internal configuration of the evacuation guidance notification system including the evacuation guidance notification device 100 configured as described above is described via FIG. 5 of the attached drawings.

Figure 5:
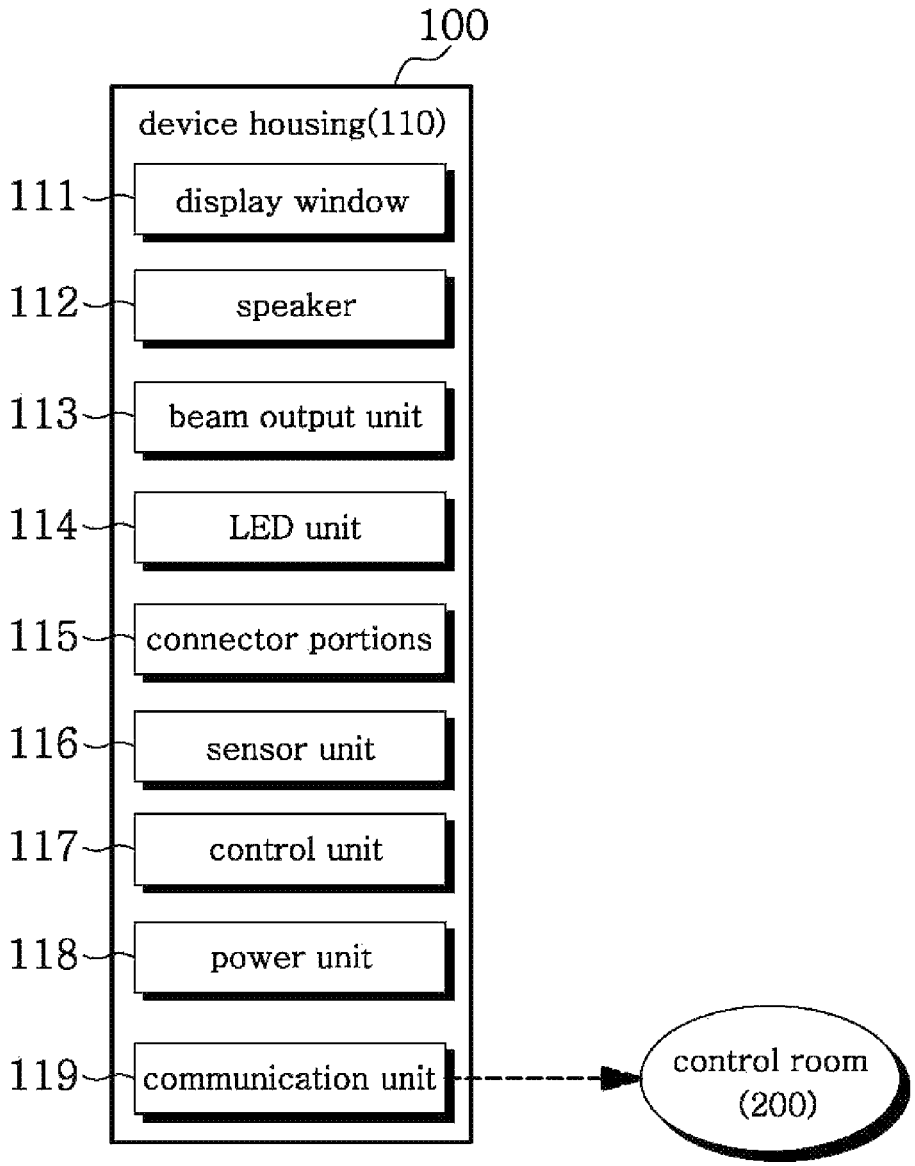
FIG. 5 is a view showing the configuration of an evacuation guidance notification system according to the present invention using a block diagram.

FIG. 5 is a view showing the configuration of an evacuation guidance notification system according to the present invention using a block diagram.

Referring to FIG. 5 of the attached drawings, the evacuation guidance notification device 100 further includes a sensor unit 116, a control unit 117, a power unit 118 and a communication unit 119 in the device housing 110.

The sensor unit 116 detects a fire by recognizing heat, smoke and gas generated in case of fire, and outputs a signal.

That is, based on the signal of the sensor unit 116, the speaker 112 outputs a voice providing notification of the fire, the beam output unit 113 radiates a beam onto a step of a staircase, and the LED unit 114 emits LED light providing notification of an outbreak of fire.

The sensor unit 116 configured to recognize heat, smoke and gas may be composed of a heat recognition sensor, a smoke recognition sensor, and a gas recognition sensor.

Furthermore, according to another design condition, the sensor unit 116 may detect a human. In this case, when a fire and a human are detected in case of fire, the evacuation guidance notification device 100 according to the present invention is allowed to operate.

In other words, the evacuation guidance notification device 100 according to the present invention may detect a fire and provide notification of an outbreak of fire, or may detect a fire and a human and provide guidance on an evacuation route while providing notification of an outbreak of fire.

When the sensor unit 116 detects a fire and generates a signal, the control unit 117 performs control so that LED light emitted by the LED unit 114 is emitted in a different color, performs control so that a beam is radiated from the beam output unit 113 in a direction to a step of a staircase, and performs control so that information about an outbreak of fire can be output via the speaker 112 in the form of voice.

The power unit 118 supplies auxiliary power when power being applied to the evacuation guidance notification device is blocked due to a fire or the like.

That is, commercial power is used in normal times. According to another condition, when power being applied to the evacuation guidance notification device is blocked in case of fire, auxiliary power may be supplied. In case of fire, the supply of commercial power may be blocked, and auxiliary power may be supplied.

Accordingly, damage resulting from the explosion of the device that may occur due to a fire is minimized by blocking commercial power and using its own auxiliary power in case of fire.

Furthermore, the power unit 118 is configured to use a rechargeable battery, charge the battery using commercial power being supplied in normal times and use the battery in case of the outbreak of an emergency situation.

The communication unit 119 is intended to enable the evacuation guidance notification device 100 to communicate with the outside. In this case, the outside is preferably the control room 200.

The control room 200 is intended to remotely control the evacuation guidance notification device 100, and is composed of a computer configured to remotely control the evacuation guidance notification device 100.

For example, when a fire breaks out in part of a building, an accident attributable to the fire may be prevented by remotely controlling the evacuation guidance notification device 100 in order to provide notification of the fire to the other part. This is described via FIG. 6 of the attached drawings.

Figure 6:
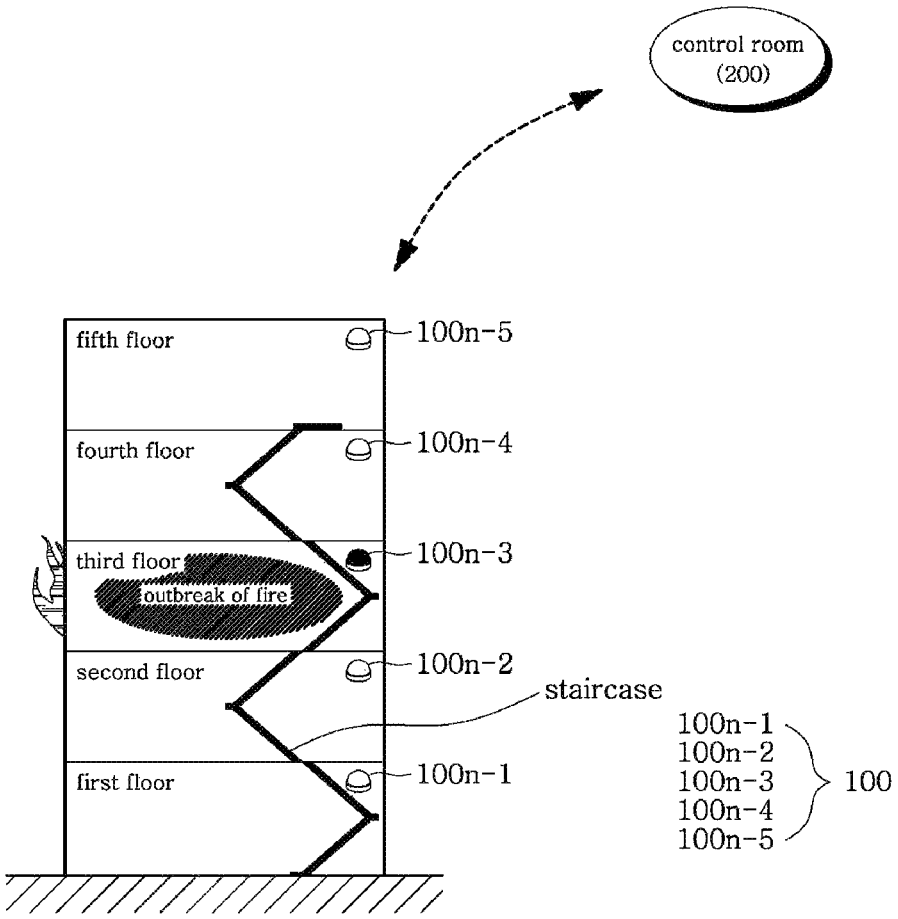
FIG. 6 is a view schematically showing an example in which a control room remotely controls an evacuation guidance notification device in an evacuation guidance notification system according to the present invention.

FIG. 6 is a view schematically showing an example in which a control room remotely controls an evacuation guidance notification device in an evacuation guidance notification system according to the present invention.

Referring to FIG. 6 of the attached drawings, a building is composed of five floors, and a fire breaks out on the third floor of the building.

Furthermore, in FIG. 6 of the attached drawings, an evacuation guidance notification device on the first floor of a building is assigned reference symbol **100*n*-1, an evacuation guidance notification device on the second floor of the building is assigned reference symbol 100*n*-2, an evacuation guidance notification device on the third floor of the building is assigned reference symbol 100*n*-3, an evacuation guidance notification device on the fourth floor of the building is assigned reference symbol 100*n*-4, and an evacuation guidance notification device on the fifth floor of the building is assigned reference symbol 100*n*-5**.

This indicates that at least one evacuation guidance notification device 100 is installed on each floor (see **100*n*), and -1, -2, -3, -4 or -5** of each reference symbol refers to a floor number.

According to the attached drawings, although the evacuation guidance notification device **100*n*-3 (at least one evacuation guidance notification device installed on the third floor) installed on a staircase on the third floor detects a fire and provides notification of the detected fire using the sensor unit having detected heat, smoke and gas generated in case of fire, the other evacuation guidance notification devices 100*n*-1, 100*n*-2, 100*n*-4 and 100*n*-5** on the first, second, fourth and fifth floors do not detect the fire.

In this case, people present on the first and second floors may become aware of a fire by viewing people who evacuate to the lower floor, but people present on the fourth floor, particularly on the fifth floor, may not be aware of the outbreak of the fire.

As another example, in the state in which a fire has broken out inside a building and an evacuation route and the fields of vision of evacuees are obstructed due to smoke and a power failure on all the floors of the building, the evacuation guidance notification device 100 is operated on the floor on which the fire has been detected and thus safe evacuation can be performed, but the evacuation guidance notification device 100 may not be operated on the floor on which the fire has not been detected and thus an incident in which evacuation is not performed may occur.

Accordingly, the evacuation guidance notification device 100 that is not operated may be operated through communication with the external control room 200 via the communication unit 119 of the evacuation guidance notification device 100.

Furthermore, the control room 200 may become aware of a failed evacuation guidance notification device 100 that does not normally operate through communication with the control room 200. The reason for this is that the control room 200 may manipulate the evacuation guidance notification devices 100 by remotely controlling them and thus the control room 200 may check the states of the evacuation guidance notification devices 100.

In this case, with regard to the determination of whether the evacuation guidance notification device 100 has failed, the control room 200 may determine whether a failure has occurred via a computer that controls the evacuation guidance notification device 100, or a failure report means (not shown) may be further included in the device housing of the evacuation guidance notification device 100.

Furthermore, the communication between the control room 200 and the evacuation guidance notification device 100 may be performed in a wireless manner. This corresponds to a commonly used technology, and a detailed description thereof is omitted.

According to the above-described configuration, the control room 200 operates the evacuation guidance notification devices 100 so that the floors other than the third floor may be notified of a fire by remotely controlling the evacuation guidance notification devices 100, thereby enabling people present on the other floors to be notified of a fire and evacuate.

Furthermore, the present invention based on another condition may not be necessarily operated in case of fire, but may be operated according to a preset schedule.

In other words, the evacuation guidance notification devices 100 may be configured not to operate in normal times but to operate in case of fire or according to a preset schedule.

Accordingly, the present invention may reduce power required for the operation of the evacuation guidance notification devices 100, may notify people using a building at night of the direction in which a staircase extends, and also may illuminate the staircase at night, thereby achieving the safe use of the building.

However, the output of a voice providing notification of a fire, and the LED light and the beam of the beam output unit, which emit light of another color in case of fire, are activated only in case of the outbreak of fire.

That is, the light of the LED and the beam of the beam output unit, which emit light in normal times, are configured to enable the safe use of the building at night based on the preset schedule.

According to still another condition, an illuminance sensor may be used.

This may be configured such that light is emitted in a staircase, which may be dark inside a building depending on the location and structure of the building, other than the preset scheduling, via the illuminance sensor, thereby providing guidance on the safe use of a building.

The evacuation guidance notification system according to the present invention, which is configured as described above, may include an output means for radiating a laser beam in addition to the beam output unit 113 of the evacuation guidance notification device 100. This will be described via FIG. 7 of the attached drawings as a second embodiment.

Embodiment 2

Evacuation Guidance Notification System Including Laser Beam

Figure 7:
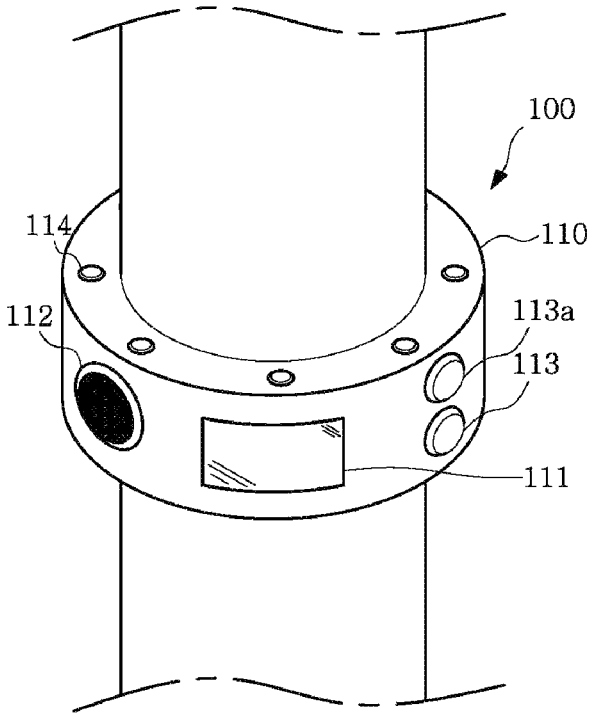
FIG. 7 is a view indicating that an evacuation guidance notification device further includes a laser beam output means configured to radiate a laser beam in an evacuation guidance notification system according to a second embodiment of the present invention.

FIG. 7 is a view indicating that an evacuation guidance notification device further includes a laser beam output means 113*a* configured to radiate a laser beam in the evacuation guidance notification system according to the second embodiment of the present invention.

According to FIG. 7 of the attached drawings, the evacuation guidance notification device 100 further includes the laser beam output means 113*a* configured to illustrate a laser beam.

The reason for this is that when in case of an outbreak of fire, the field of vision of an evacuee who evacuates is obstructed by smoke generated by a fire, the field of vision may not be ensured only by the LED beam of the beam output unit 113 or the LED light of the LED unit 114.

Accordingly, the evacuation guidance notification device according to the second embodiment of the present invention may include the laser beam output means 113*a* configured to radiate a laser beam onto a staircase in order to ensure a better field of vision.

Meanwhile, it will be apparent that the shapes of the beam output unit 113 and the laser beam output means 113*a* shown in FIG. 7 of the attached drawings are not limited to those shown in the drawing, but may be formed in various shapes. It is sufficient if the beam output unit 113 and the laser beam output means 113*a* perform the function of radiating a beam onto a step of a staircase, thereby achieving the object of ensuring the field of vision of an evacuee.

The above-described evacuation guidance notification system according to the present invention is configured to operate in conjunction with a fire image and voice detection device disclosed in Korean Patent Application No. 10-2012-0085515 filed on Aug. 6, 2012, which has been described in the "Background of Art" section of the present specification. This will be described via FIG. 8 of the attached drawings as a third embodiment.

Embodiment 3

Figure 8:
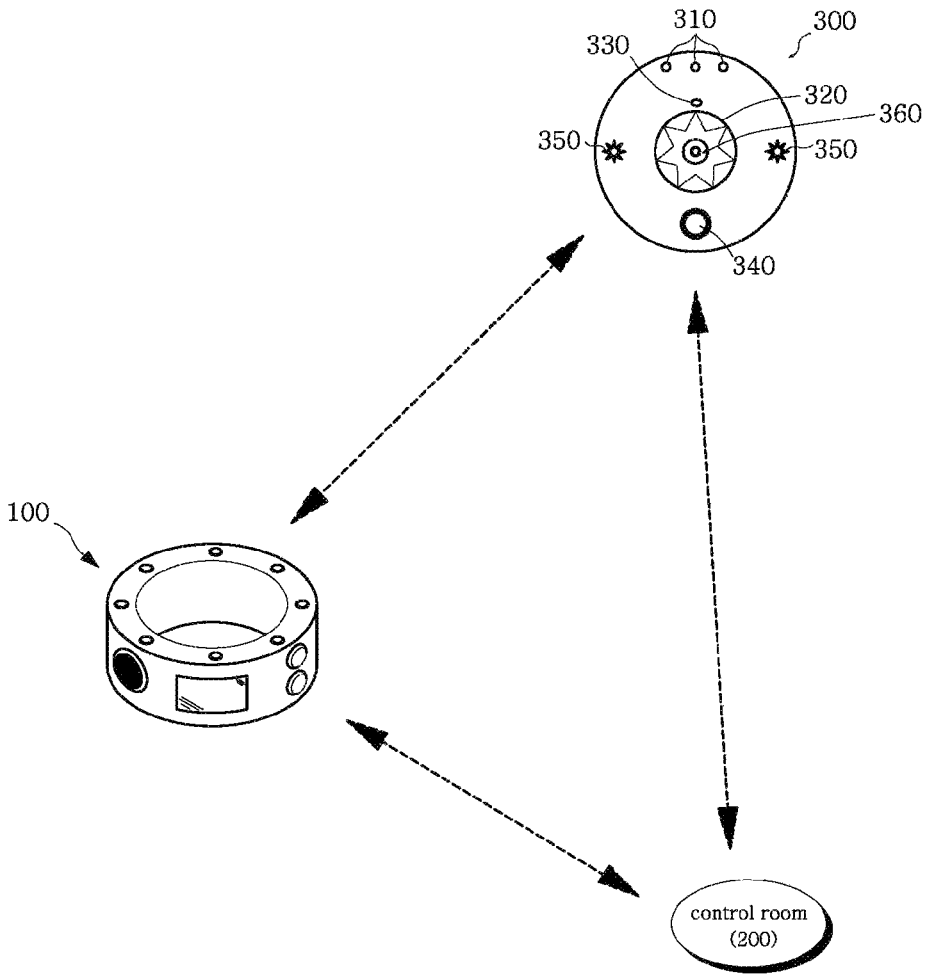
FIG. 8 is a view indicating that an evacuation guidance notification system according to a third embodiment of the present invention operates in conjunction with a fire image and voice detection device.

Evacuation Guidance Notification System Operating in Conjunction with a Fire Image and Voice Detection Device FIG. 8 is a view indicating that the evacuation guidance notification system according to the third embodiment of the present invention operates in conjunction with the fire image and voice detection device.

The fire image and voice detection device 300 disclosed in the above-described patent application filed by the present applicant is configured to chiefly include a communication unit 310, a heat and smoke recognition sensor unit 320, a microphone 330, a speaker unit 340, an LED light unit 350, and an image camera unit 360.

Furthermore, the fire image and voice detection device 300 is installed on the ceiling of the building. When a fire breaks out, the fire image and voice detection device 300 may transmit its image signal and thus a user may become aware of the outbreak of fire over a remote distance, may store the image and thus may enable the cause of the outbreak of the fire to be easily identified, and may provide guidance on an evacuation route while emitting LED light that assists in ensuring a field of vision in a smoky environment. The fire image and voice detection device 300 may detect a fire by recognizing a voice (see "Fire Image and Voice Detection Apparatus" disclosed in Korean Patent Application No. 10-2012-0085515).

That is, according to the above-described patent application, a fire may be detected using a voice including the term "fire." The effects of the patent application are to automatically provide notification of an outbreak of fire, to transmit the image information of a fire site, thereby smoothly instructing the extinguishment of a fire or the evacuation of people over a remote distance, to store the image information, thereby enabling the image information to be used to identify the cause of the fire, and to emit LED light having superior visibility when a field of vision is obstructed by smoke at a fire site, thereby enabling people to become aware of an evacuation location and thus minimizing loss of lives.

The evacuation guidance notification system according to the third embodiment of the present invention, which operates in conjunction with the above-described fire image and voice detection device, is remotely controlled from the control room 200. The evacuation guidance notification system and the fire image and voice detection device may be controlled in conjunction with each other.

In other words, both the fire image and voice detection device 300 and the evacuation guidance notification device 100 may be controlled from the control room 200.

Furthermore, when the fire image and voice detection device 300 detects a fire, the fire image and voice detection device 300 may be configured to detect the fire in conjunction with the evacuation guidance notification device 100. In contrast, when the evacuation guidance notification device 100 detects a fire, the fire image and voice detection device 300 may be configured to detect the fire.

This is configured such that the communication units of the evacuation guidance notification device 100 and the fire image and voice detection device 300 communicate with each other. This communication may be performed in a wireless or wired manner.

According to another condition, the fire image and voice detection device 300 and the evacuation guidance notification device 100 may be configured such that a voice or a sound can operate in conjunction with each other.

For example, when the speaker formed in the device housing of the evacuation guidance notification device 100 outputs a voice providing notification of an outbreak of fire, the fire image and voice detection device 300 amplifies and detects the voice of the evacuation guidance notification device 100 via the microphone 330, and then detects a fire.

For this purpose, it will be apparent that a voice providing notification of an outbreak of fire output by the evacuation guidance notification device may be set to a voice including the term "fire" and stored in the fire image and voice detection device.

In summary, the evacuation guidance notification system according to the third embodiment of the present invention may allow a communication unit to be reconfigured to operate in conjunction with the fire image and voice detection device, or may additionally include a communication means.

According to another condition, the present invention may further include an evacuation direction guidance unit configured to provide guidance on an evacuation direction in the evacuation guidance notification device 100.

This will be described via FIGS. 9 and 10 of the attached drawings as a fourth embodiment.

Embodiment 4

Figure 9:
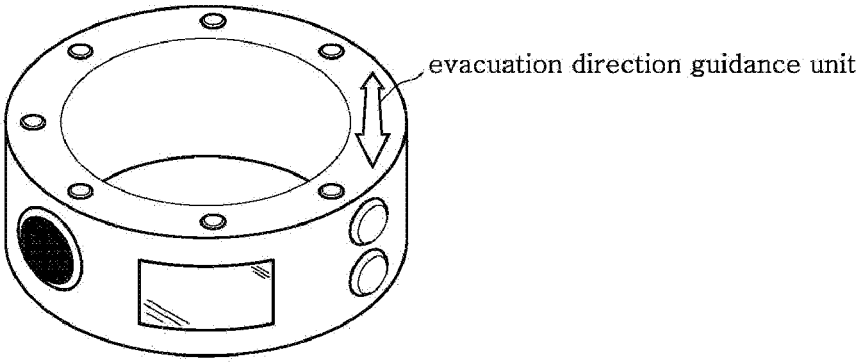
FIG. 9 is a view showing the configuration of an evacuation guidance notification device in an evacuation guidance notification system according to a fourth embodiment of the present invention.

Evacuation Guidance Notification System Further Including Evacuation Direction Guidance Unit FIG. 9 is a view showing the configuration of an evacuation guidance notification device in an evacuation guidance notification system according to a fourth embodiment of the present invention.

The evacuation guidance notification device of the evacuation guidance notification system according to the fourth embodiment of the present invention further includes an evacuation direction guidance unit, as shown in FIG. 9 of the attached drawings.

This is indicated on the top surface of the evacuation guidance notification device in the shape of an arrow in order to provide guidance on an evacuation direction, as shown in the attached drawing. This may not be necessarily implemented in the shape of an arrow. It is sufficient if the purpose of providing guidance on an evacuation direction is achieved.

For this purpose, the evacuation direction guidance unit may be composed of an LED light, an infrared light, or the like, and may emit light.

Furthermore, the evacuation direction guidance unit may be formed on the top surface of the evacuation guidance notification device, as shown in FIG. 9 of the attached drawings, may be formed on a side surface thereof, or may be formed on another side of the top surface. It is sufficient if the location thereof is the location at which an evacuee can identify the evacuation direction guidance unit.

The reason for this is that the direction in which an evacuee can conveniently identify the evacuation direction guidance unit may vary depending on the structure of a staircase or the location of a building.

The evacuation direction guidance unit may indicate the direction in which evacuation is possible and the direction in which evacuation is impossible using lights of different colors.

For example, the direction in which evacuation is possible may be indicated by the blue color, and the direction in which evacuation is impossible may be indicated by the red color. The colors are not necessarily limited to the blue and red colors, and may be configured to be other colors by the manipulation of an operator.

According to another condition, the evacuation direction guidance unit may indicate only the direction in which evacuation is possible.

In other words, an evacuee may be guided and notified through and of the direction in which evacuation is possible by not emitting light for the direction in which evacuation is impossible and emitting light for the direction in which evacuation is possible.

According to still another condition, an evacuee may be guided through the evacuation direction via the speaker 112 of the evacuation guidance notification device 100.

For example, when a fire breaks out on the third floor, as shown in the attached drawings, notification of evacuation to the first or second floor, i.e., a lower floor, may be provided in the form of voice, and notification of a path along which evacuation is possible may be provided in the form of voice.

The notification of an evacuation direction via the evacuation direction guidance unit or speaker 112 according to the fourth embodiment may be operated under the control of the control unit provided in the evacuation guidance notification device 100. According to another condition, this may be achieved through the remote control of the control room 200.

Accordingly, the evacuation direction guidance unit may provide guidance on an evacuation direction along a staircase in case of fire. That is, when a fire breaks out and thus evacuation is performed, guidance on whether to evacuate from a staircase to an upper floor and escape to the rooftop of a building or to evacuate from a staircase to a lower floor and escape from a building may be provided, thereby guiding an evacuee through safe evacuation.

An example of the operation of the evacuation guidance notification device 100 including the evacuation direction guidance unit will be described via FIG. 10 of the attached drawings.

Figure 10:
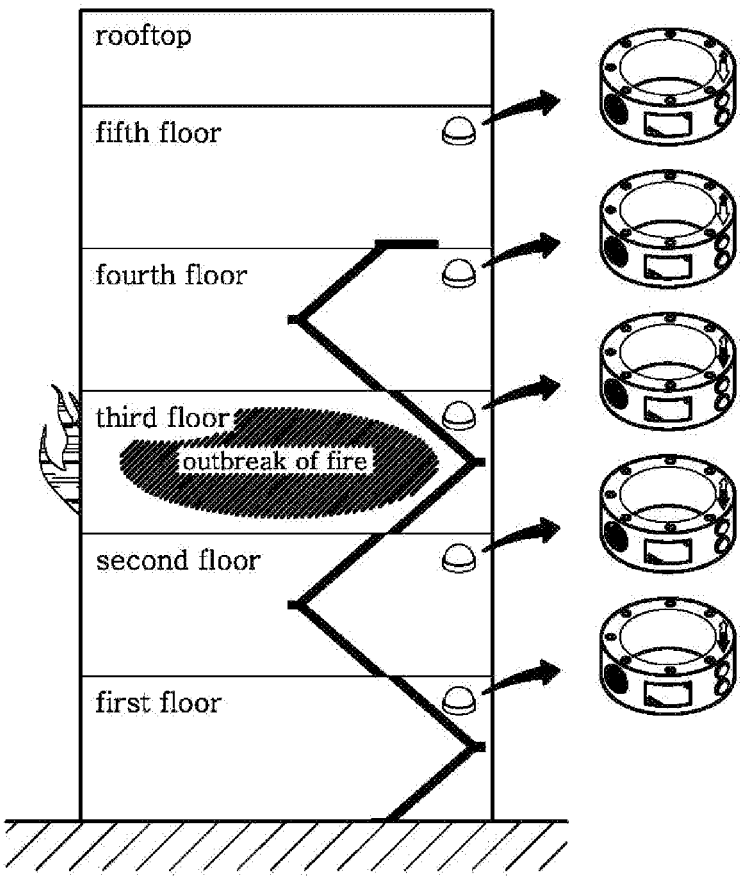
FIG. 10 is a view showing an example of the operation of the evacuation guidance notification system according to the fourth embodiment of the present invention.

FIG. 10 is a view showing an example of the operation of the evacuation guidance notification system according to the fourth embodiment of the present invention.

Referring to FIG. 10 of the attached drawings, a fire breaks out on the third floor of a building composed of five floors. Evacuation direction guidance units formed in evacuation guidance notification devices on the first, second and third floors provide guidance on an evacuation direction to a lower floor, and evacuation direction guidance units formed in evacuation guidance notification devices on the fourth and fifth floors provide guidance on an evacuation direction to an upper floor.

Since this is illustrated in order to describe an example of the operation of the evacuation direction guidance units via a drawing, the fourth embodiment of the present invention cannot be limited to the drawing.

As an example, since it may be possible to identify a fire site using an image in conjunction with the fire image and voice detection device according to the above-described third embodiment, evacuees on the fourth and fifth floors may be guided to a rooftop on the fifth floor when it is impossible to provide guidance on evacuation to the third floor on which the fire has broken out.

Furthermore, an operator that has become aware of the situation may provide notification that the evacuees stay on the rooftop by reporting to a relevant government office (a fire station or the like), thereby achieving the advantage of safely rescuing the evacuees.

According to another condition, it will be apparent that guidance on an evacuation direction may be provided under the control of the control unit.

The evacuation guidance notification system according to the present invention, which is configured as described above, provides the effect of enabling evacuees to safely evacuate because the evacuation guidance notification devices are installed on banister posts of staircases, because the fields of vision of evacuees can be ensured via the LED units formed in the evacuation guidance notification devices even when the fields of vision are obstructed by smoke and the like in case of fire, and because an evacuation route can be ensured and guidance can be provided via the beam output units.

Accordingly, secondary accidents (tripping, getting hit by another evacuee during evacuation, confusion attributable to ignorance about the structure of a building, and the like) that may occur during evacuation can be prevented.

Furthermore, the evacuation guidance notification system according to the present invention can provide the effect of enabling people to become aware of an outbreak of fire because light emitted by the LED formed in the evacuation guidance notification device is configured to be emitted in another color in case of fire, and can also provide the effect of guiding an evacuee through rapid evacuation in case of fire because a voice providing notification of an outbreak of fire is output via the speaker.

Furthermore, the evacuation guidance notification system according to the present invention can provide the effect of guiding an evacuee through accurate and rapid evacuation because the evacuation guidance notification device according to the present invention is installed on one side of a staircase and radiates a beam onto a step of the staircase, thereby providing accurate notification of the boundary of the step of the staircase.

Furthermore, the evacuation guidance notification system according to the present invention can provide an effect in which control is performed such that notification of an outbreak of fire can be provided throughout an entire building even when a fire breaks out in part of the building and thus guidance on an evacuation route can be provided because the communication units capable of communicating with the outside can be provided in the evacuation guidance notification devices according to the present invention and thus remote control can be performed.

Meanwhile, since only the essential particulars of the present invention have been described using FIGS. 2 to 10 and various types of design can be made within a corresponding technical range, it is apparent that the present invention is not limited to the configurations of FIGS. 2 to 10.

The invention claimed is:

1. An evacuation guidance notification device, comprising a device housing, a display window, a speaker, a beam output unit, an LED unit, a sensor unit, a control unit, a power unit, a communication unit, and an evacuation direction guidance unit;

wherein the device housing is formed in a ring shape having an opening so that it is fitted and installed on a banister post of a staircase;

wherein the sensor unit detects a fire by sensing heat, smoke or gas generated by the fire, detects a human using an infrared ray, and outputs a signal when detecting any one or more of the fire and the human, including the fire;

wherein the LED unit emits LED light in normal times, and emits LED light of another color based on the signal of the sensor unit when the fire breaks out;

wherein the beam output unit emits a beam in a direction to a step of the staircase in normal times, and emits LED light of another color based on the signal of the sensor unit when the fire breaks out;

wherein the communication unit enables communication with an outside;

wherein the evacuation direction guidance unit:

guides an evacuee through an evacuation direction along the staircase in case of fire; and indicates a direction in which evacuation is possible and a direction in evacuation is impossible by emitting lights of different colors; and wherein the control unit automatically controls the light emitted by the LED unit according to a preset scheduling, thereby reducing power required for operation and providing guidance on safe use of a building.

2. The evacuation guidance notification device of claim 1, wherein the device housing:

is divided into a first housing and a second housing; and further comprises connector portions configured to couple the first housing and the second housing with each other.

3. An evacuation guidance notification system, comprising:

the evacuation guidance notification device set forth in claim 1; and a computer installed in a control room in order to remotely control the evacuation guidance notification device.

4. An evacuation guidance notification system, comprising:

the evacuation guidance notification device set forth in claim 1; and a fire image and voice detection device configured to operate in conjunction with the evacuation guidance notification device;

wherein the evacuation guidance notification device further comprises a communication means configured to communicate with the fire image and voice detection device; and wherein any one selected from the evacuation guidance notification device or the fire image and voice detection device detects a fire, a remaining apparatus operates in conjunction with the any one apparatus.

* * * * *